US012245698B2

(12) United States Patent
Kuhl et al.

(10) Patent No.: US 12,245,698 B2
(45) Date of Patent: Mar. 11, 2025

(54) COMPONENTS, KITS, BED FRAMES, BEDS, AND METHODS OF MANUFACTURE AND USE THEREOF

(71) Applicant: Burrow, Inc., New York, NY (US)

(72) Inventors: Stephen Kuhl, New York, NY (US); Evan Clabots, Brooklyn, NY (US); Brian Ornduff, Brooklyn, NY (US)

(73) Assignee: Burrow, Inc., New York, NY (US)

( * ) Notice: Subject to any disclaimer, the term of this patent is extended or adjusted under 35 U.S.C. 154(b) by 0 days.

(21) Appl. No.: 18/585,624

(22) Filed: Feb. 23, 2024

(65) Prior Publication Data

US 2024/0188722 A1 Jun. 13, 2024

Related U.S. Application Data

(63) Continuation of application No. PCT/US2023/012074, filed on Feb. 1, 2023.

(60) Provisional application No. 63/315,848, filed on Mar. 2, 2022, provisional application No. 63/305,585, filed on Feb. 1, 2022.

(51) Int. Cl.
*A47C 19/00* (2006.01)
*A47C 19/02* (2006.01)

(52) U.S. Cl.
CPC ..... *A47C 19/005* (2013.01); *A47C 19/022* (2013.01); *A47C 19/024* (2013.01); *A47C 19/025* (2013.01)

(58) Field of Classification Search
CPC ... A47C 19/005; A47C 19/022; A47C 19/024; A47C 19/025; A47C 23/06; A47C 23/061
See application file for complete search history.

(56) References Cited

U.S. PATENT DOCUMENTS

| | | | | |
|---|---|---|---|---|
| 2,567,619 | A * | 9/1951 | Rosenfeld | A47C 19/024 280/659 |
| 3,973,800 | A | 8/1976 | Kogan | |
| 4,169,294 | A * | 10/1979 | Harris | A47C 19/021 5/200.1 |
| 6,081,946 | A * | 7/2000 | Kennedy | A47C 19/04 5/200.1 |
| 7,188,379 | B2 | 3/2007 | James | |
| D608,561 | S | 1/2010 | Chen | |
| D608,562 | S | 1/2010 | Chen | |
| 7,882,581 | B2 | 2/2011 | Felix, Jr. | |
| 8,332,973 | B2 | 12/2012 | Davis | |

(Continued)

FOREIGN PATENT DOCUMENTS

| | | |
|---|---|---|
| CN | 107048837 | 8/2017 |
| CN | 207532184 | 6/2018 |

(Continued)

OTHER PUBLICATIONS

International Search Report and Written Opinion dated May 2, 2023 in corresponding Application PCT/US2023/012074 (15 pages).

(Continued)

*Primary Examiner* — Justin C Mikowski
*Assistant Examiner* — Alison N Labarge
(74) *Attorney, Agent, or Firm* — Dentons US LLP

(57) ABSTRACT

Generally, this disclosure enables a bed that can be easily assembled by an end user on premises of end use (e.g., a bedroom), while also being efficiently packaged for delivery to or assembly in a tight area (e.g., an apartment building).

30 Claims, 11 Drawing Sheets

(56) References Cited

U.S. PATENT DOCUMENTS

| | | | |
|---|---|---|---|
| 8,375,482 | B1 | 2/2013 | Owens |
| D718,552 | S | 12/2014 | Kanthasamy |
| D719,753 | S | 12/2014 | Pathiratne |
| D719,754 | S | 12/2014 | Pathiratne |
| D720,943 | S | 1/2015 | Pathiratne |
| 8,931,123 | B1 | 1/2015 | Oh |
| 8,935,819 | B1 | 1/2015 | Hartley |
| 8,990,979 | B1 | 3/2015 | Craver |
| 9,351,583 | B2 | 5/2016 | Baldassarra |
| 9,474,382 | B2 | 10/2016 | Oh |
| 9,596,943 | B1 | 3/2017 | Hartley |
| 9,629,466 | B2 | 4/2017 | Griggs, Jr. |
| D785,968 | S | 5/2017 | Burden |
| D810,458 | S | 2/2018 | Cartier |
| 9,924,803 | B2 | 3/2018 | Rodgers |
| 10,045,628 | B2 | 8/2018 | Lee |
| 10,182,660 | B2 | 1/2019 | Lee |
| 10,188,217 | B2 | 1/2019 | Harrow |
| 10,349,753 | B2 | 7/2019 | Rox |
| 10,362,879 | B2 | 7/2019 | Lee |
| 10,362,880 | B2 | 7/2019 | Oh |
| 10,390,626 | B2 | 8/2019 | Oh |
| 10,390,627 | B2 | 8/2019 | Lee |
| D862,104 | S | 10/2019 | Suzuki |
| D862,105 | S | 10/2019 | Liu |
| 10,508,674 | B2 | 12/2019 | Harrow |
| 10,512,337 | B2 | 12/2019 | Leng |
| 10,537,183 | B2 | 1/2020 | Nault |
| 10,539,170 | B2 | 1/2020 | Griffith |
| D875,421 | S | 2/2020 | Bernhardt |
| 10,582,775 | B2 | 3/2020 | Lee |
| 10,595,643 | B2 | 3/2020 | Harrow |
| D885,077 | S | 5/2020 | Kamler |
| 10,660,447 | B2 | 5/2020 | Polevoy |
| 10,709,254 | B2 | 7/2020 | Jewett |
| D899,804 | S | 10/2020 | Carter |
| D904,784 | S | 12/2020 | Suzuki et al. |
| D906,000 | S | 12/2020 | Hernandez |
| 10,898,004 | B2 | 1/2021 | Nitori |
| D911,059 | S | 2/2021 | Fang |
| 10,905,245 | B2 | 2/2021 | Bangalore |
| D917,193 | S | 4/2021 | Shen |
| D917,194 | S | 4/2021 | Shen |
| D917,195 | S | 4/2021 | Shen |
| D917,196 | S | 4/2021 | Shen |
| 11,006,761 | B2 | 5/2021 | Harrow |
| 11,006,763 | B1 | 5/2021 | Oh |
| 11,083,306 | B1 | 8/2021 | Thompson |
| 11,085,479 | B2 | 8/2021 | Griffith |
| 11,134,791 | B2 | 10/2021 | Hutton |
| 2005/0278848 | A1* | 12/2005 | Polevoy ..... A47C 19/04 5/310 |
| 2008/0148478 | A1 | 6/2008 | Patella |
| 2009/0288253 | A1* | 11/2009 | Jin ..... A47C 19/005 5/285 |
| 2015/0026881 | A1 | 1/2015 | Nault |
| 2016/0255963 | A1* | 9/2016 | Jones ..... A47C 19/025 |
| 2017/0238715 | A1 | 8/2017 | Choi |
| 2017/0273468 | A1 | 9/2017 | Polevoy |
| 2019/0021508 | A1* | 1/2019 | Jewett ..... A47C 19/021 |
| 2019/0099006 | A1 | 4/2019 | Gerig |
| 2020/0040927 | A1* | 2/2020 | Self ..... A47C 19/025 |
| 2021/0059420 | A1 | 3/2021 | Oh |
| 2021/0196052 | A1 | 7/2021 | Hutton |
| 2021/0227985 | A1* | 7/2021 | Thompson ..... F16B 12/56 |
| 2021/0282564 | A1 | 9/2021 | Chen |
| 2021/0341006 | A1 | 11/2021 | Griffith |
| 2021/0393039 | A1 | 12/2021 | Hutton |
| 2021/0393040 | A1 | 12/2021 | Sun |

FOREIGN PATENT DOCUMENTS

| | | | | |
|---|---|---|---|---|
| CN | 109171187 | A | 1/2019 | |
| FR | 2720914 | A1 * | 12/1995 | ..... A47C 19/005 |
| KR | 102197093 | B1 | 12/2020 | |
| SE | 1951457 | | 6/2021 | |
| WO | WO2010041102 | A1 | 4/2010 | |
| WO | DM102097-003 | | 4/2018 | |
| WO | DM202334-011 | | 1/2019 | |
| WO | WO2019018624 | A1 | 1/2019 | |
| WO | WO2020079305 | A1 | 4/2020 | |
| WO | DM213884-002 | | 5/2021 | |
| WO | WO2021150466 | A1 | 7/2021 | |
| WO | DM216834-001 | | 9/2021 | |

OTHER PUBLICATIONS

BDEUS 14 inch wood slat platform bed frame with tool-free assembly, 100% wooden frame mattress foundation, 5 minutes assembly, sturdy, no noise, no box spring need, twin size (https://www.u-buy.jp/en/product/1AHR5MI3K-bdeus-14-inch-wood-slat-platform-bed-frame-with-tool-free-assembly-100-wooden-frame-mattress-foundation-5-minutes-assembly-sturdy-no-noise-no), downloaded from Internet Jan. 21, 2022 (2 pages).

* cited by examiner

COMPONENTS, KITS, BED FRAMES, BEDS, AND METHODS OF MANUFACTURE AND USE THEREOF

CROSS-REFERENCE TO RELATED PATENT APPLICATIONS

This patent application is a Continuation of International Application PCT/US2023/012074 filed 1 Feb. 2023; which claims a benefit of priority to U.S. patent application 63/305,585 filed 1 Feb. 2022 and U.S. patent application 63/315,848 filed 2 Mar. 2022; each of which is incorporated by reference herein for all purposes.

TECHNICAL FIELD

This disclosure relates to components, kits, bed frames, beds, and methods of manufacture and use thereof.

BACKGROUND

There is a desire to enable a bed that can be easily assembled by an end user on premises of end use (e.g., a bedroom), while also being efficiently packaged for delivery to or assembly in a tight area (e.g., an apartment building).

SUMMARY

Generally, this disclosure enables a bed that can be easily assembled by an end user on premises of end use (e.g., a bedroom), while also being efficiently packaged for delivery to or assembly in a tight area (e.g., an apartment building).

There may be a method, comprising: sending a head rail, a foot rail, a first side rail, a second side rail, an intermediate rail, a corner leg, a slat, a first post, and a second post to an end user; and causing the end user to: span (i) the first side rail between the head rail and the foot rail and (ii) the second side rail between the head rail and the foot rail; extend the first post in (i) the head rail and the first side rail or the second side rail or (ii) the foot rail and the first side rail or the second side rail as the first post extends from the corner leg; span the intermediate rail between the head rail and the foot rail such that the intermediate rail extends between the first side rail and the second side rail; and deposit the slat on the intermediate rail and the first side rail or the second side rail between the head rail and the foot rail such that (i) the first post extends in the slat as the corner leg supports the head rail or the foot rail and (ii) the second post extends in the slat as the second post extends from the intermediate rail.

There may be a method, comprising: accessing a head rail, a foot rail, a first side rail, a second side rail, an intermediate rail, a corner leg, a slat, a first post, and a second post; spanning (i) the first side rail between the head rail and the foot rail and (ii) the second side rail between the head rail and the foot rail; extending the first post in (i) the head rail and the first side rail or the second side rail or (ii) the foot rail and the first side rail or the second side rail as the first post extends from the corner leg; spanning the intermediate rail between the head rail and the foot rail such that the intermediate rail extends between the first side rail and the second side rail; and depositing the slat on the intermediate rail and the first side rail or the second side rail between the head rail and the foot rail such that (i) the first post extends in the slat as the corner leg supports the head rail or the foot rail and (ii) the second post extends in the slat as the second post extends from the intermediate rail.

There may be a kit, comprising: a head rail, a foot rail, a first side rail, a second side rail, an intermediate rail, a corner leg, a slat, a first post, and a second post configured to enable: a span of (i) the first side rail between the head rail and the foot rail and (ii) the second side rail between the head rail and the foot rail; an extension of the first post in (i) the head rail and the first side rail or the second side rail or (ii) the foot rail and the first side rail or the second side rail as the first post extends from the corner leg; a span of the intermediate rail between the head rail and the foot rail such that the intermediate rail extends between the first side rail and the second side rail; and a deposit of the slat on the intermediate rail and the first side rail or the second side rail between the head rail and the foot rail such that (i) the first post extends in the slat as the corner leg supports the head rail or the foot rail and (ii) the second post extends in the slat as the second post extends from the intermediate rail.

There may be a device, comprising: a bed frame including a head rail, a foot rail, a first side rail, a second side rail, an intermediate rail, a corner leg, a slat, a first post, and a second post, wherein the first side rail spans between the head rail and the foot rail, wherein the second side rail spans between the head rail and the foot rail, wherein the first post extends in (i) the head rail and the first side rail or the second side rail or (ii) the foot rail and the first side rail or the second side rail as the first post extends from the corner leg, wherein the intermediate rail spans between the head rail and the foot rail such that the intermediate rail extends between the first side rail and the second side rail, wherein the slat is deposited on the intermediate rail and the first side rail or the second side rail between the head rail and the foot rail such that (i) the first post extends in the slat as the corner leg supports the head rail or the foot rail and (ii) the second post extends in the slat as the second post extends from the intermediate rail.

There may be a device, comprising: a first mattress, a second mattress, and a hinge spanning between the first mattress and the second mattress such that the first mattress is able to hingedly stack on the second mattress.

DETAILED DESCRIPTION

Figure 1:
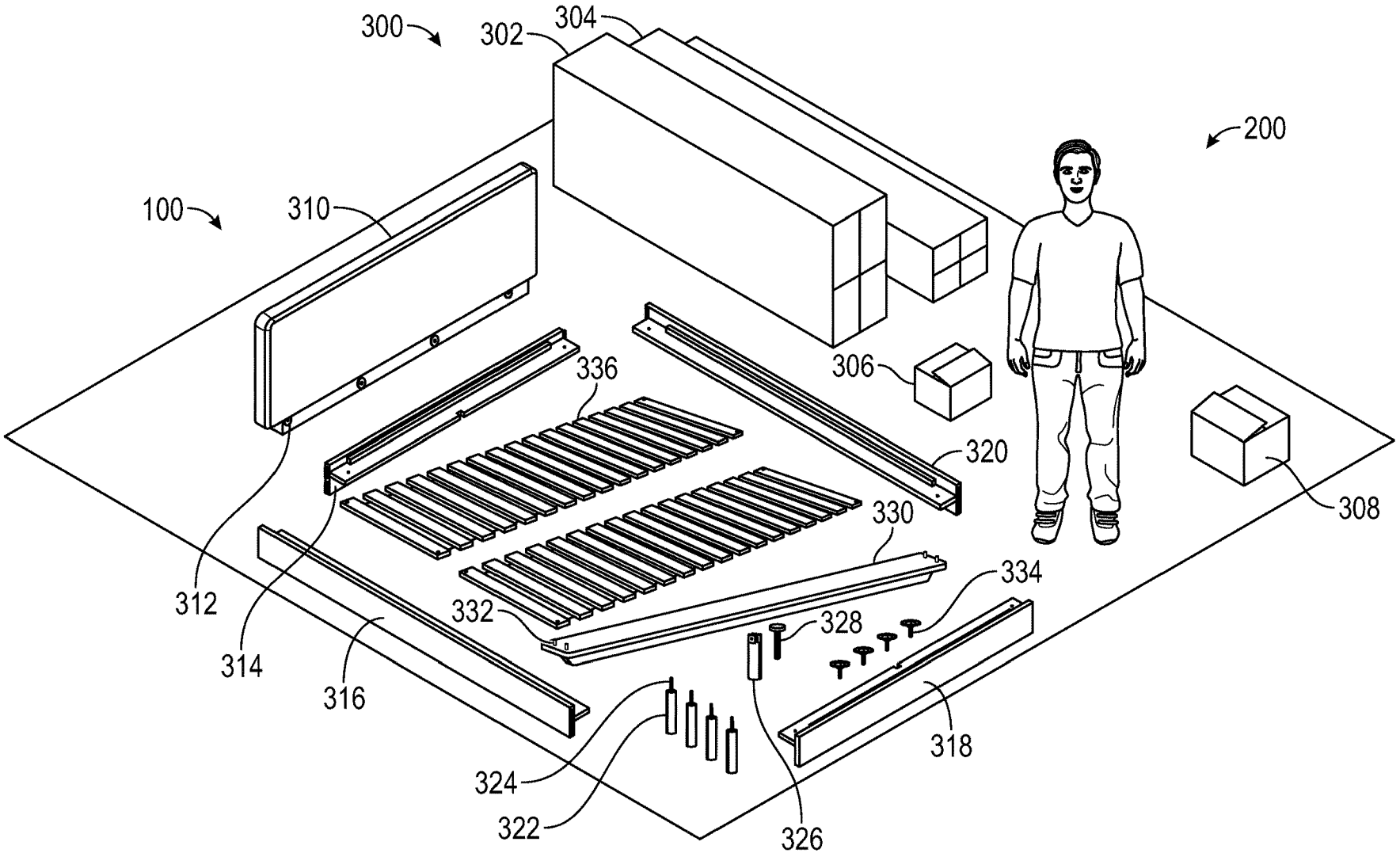
FIG. 1 shows an example of a kit for assembly into a bed frame according to this disclosure.

Generally, this disclosure enables a bed that can be easily assembled by an end user on premises of end use (e.g., a bedroom), while also being efficiently packaged for delivery to or assembly in a tight area (e.g., an apartment building). However, note that this disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

Various singular forms "a," "an" and "the" are intended to include various plural forms (e.g., two, three, four, five, six, seven, eight, nine, ten, tens, hundreds, thousands) as well, unless specific context clearly indicates otherwise.

Various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" or another conceptually similar terminology refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise contextually apparent.

Unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense, unless expressly so defined herein.

Relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

Although the terms first, second, can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary or monolithic, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, chiseling, cutting, and so forth.

Hereby, all issued patents, published patent applications, and non-patent publications that are mentioned or referred to in this specification are herein incorporated by reference in their entirety for all purposes, to a same extent as if each individual issued patent, published patent application, or non-patent publication were specifically and individually indicated to be incorporated by reference. To be even more clear, all incorporations by reference specifically include those incorporated publications as if those specific publications are copied and pasted herein, as if originally included in this disclosure for all purposes of this disclosure. Therefore, any reference to something being disclosed herein includes all subject matter incorporated by reference, as explained above. However, if any disclosures are incorporated herein by reference and such disclosures conflict in part or in whole with this disclosure, then to an extent of the conflict or broader disclosure or broader definition of terms, this disclosure controls. If such disclosures conflict in part or in whole with one another, then to an extent of conflict, the later-dated disclosure controls.

FIG. 1 shows an example of a kit for assembly into a bed frame according to this disclosure. In particular, an area 100 (e.g., a bedroom) contains an end user 200 (e.g., an adult person) and a kit 300. The end user 200 may include an agent (e.g., a friend, a roommate, a household member, a technician) acting on behalf of or assisting the end user 200 in the area 100 with handling, holding, carrying, depositing, unpackaging, or assembling the kit 300, as further described below.

The kit 300 includes a package 302 (e.g., a box), a package 304 (e.g., a box), a package 306 (e.g., a box), and a package 308 (e.g., a box), shipped from a single or multiple locales (e.g., a building, a fulfillment center, a warehouse) to the end user 200, who desires to possess the kit 300 (e.g., a buyer, a renter, a lessee, a donee) from a provider (e.g., a seller, an owner, a lessor, a donor) thereof, whether the provider is a single actor or multiple actors. Although the kit 300 may include less packages or more packages, how many packages may be in the kit 300 may be determined based on various potential factors, size constraints, or weight constraints imposed by a governmental mail service (e.g., USPS), a common courier (e.g., UPS, FedEx, DHL), an area for delivery of the kit 300 (e.g., a vestibule, a hallway, a landing of a staircase, a staircase, a doorway, an elevator, an escalator, an attic, a basement), or an area where the kit 300 is handled, held, carried, deposited, unpackaged, or assembled on premises (e.g., height, length, width), which may be chosen by the provider or the end user 200. The package 302, the package 304, the package 306, or the package 308 can be of an identical form-factor (e.g., a box) or different form-factors (e.g., a box and an envelope), subject to various potential factors, size constraints, or weight constraints imposed by a governmental mail service (e.g., USPS), a common courier (e.g., UPS, FedEx, DHL), an area for delivery of the kit 300 (e.g., a vestibule, a hallway, a landing of a staircase, a staircase, a doorway, an elevator, an escalator, an attic, a basement), or an area where the kit 300 is handled, held, carried, deposited, unpackaged, or assembled on premises (e.g., height, length, width), which may be chosen by the provider or the end user 200. As such, how many packages may be used or what form-factor those packages take may be technologically advantageous to enable the kit 300 to be easily assembled by the end user 200 on premises of end use (e.g., a bedroom), while also being efficiently packaged for delivery to or assembly in a tight area (e.g., an apartment building).

The package 302 contained a headboard 310 having a set of bores 312 when shipped (e.g., sent) by the provider thereof to the end user 200 via a governmental mail service (e.g., USPS) or a common courier (e.g., UPS, FedEx, DHL) and deposited in the area 100 by the end user 200 before opening the package 302 by the end user 200, after receipt thereof. After opening the package 302, the end user 200 removes the headboard 310 from the package 302.

The package 304 contained a head rail 314, a side rail 316 (first), a foot rail 318, a side rail 320 (second), and an intermediate rail 330 when shipped (e.g., sent) by the provider thereof to the end user 200 via a governmental mail service (e.g., USPS) or a common courier (e.g., UPS, FedEx, DHL) and deposited in the area 100 by the end user 200 before opening the package 304 by the end user 200, after receipt thereof. After opening the package 304, the end user 200 removes the head rail 314, the side rail 316, the foot rail 318, the side rail 320, and the intermediate rail 330 from the package 304. For example, any of the head rail 314, the foot rail 318, the side rail 316, the side rail 320, or the intermediate rail 330 may include wood. The head rail 314 may host an indicator thereof (e.g., a sticker, a writing, an engraving, an embossment, a color-coded indicia). The foot rail 318 may host an indicator thereof (e.g., a sticker, a writing, an engraving, an embossment, a color-coded indicia).

The intermediate rail 330 includes a set of posts 332 when contained in the package 304 and shipped by the provider thereof to the end user 200, but this configuration is not required and the set of posts 332 (or any individual post 332) can be shipped in a separate package by the provider to the end user 200 to be assembled by the end user 200 with the intermediate rail 330 in the area 100, whether the separate package contains other components of the kit 300 or not. Likewise, the head rail 314, the side rail 316, the foot rail 318, the side rail 320, and the intermediate rail 330 can be shipped in other packaging configurations, whether together or separate from each other or other components of the kit 300 (e.g., the headboard 310). For example, at least two of the head rail 314, the side rail 316, the foot rail 318, the side rail 320, and the intermediate rail 330 can be in a single package. Similarly, each or some of the head rail 314, the side rail 316, the foot rail 318, the side rail 320, and the intermediate rail 330 can be shipped in its own package. Likewise, some or each of the head rail 314, the side rail 316, the foot rail 318, the side rail 320, and the intermediate rail 330 can be omitted from the package 304 and be shipped separately.

The package 306 contained a set of corner legs 322 having a set of posts 324, an intermediate leg 326, a fastener 328, and a set of fasteners 334 when shipped (e.g., sent) by the provider thereof to the end user 200 via a governmental mail service (e.g., USPS) or a common courier (e.g., UPS, FedEx, DHL) and deposited on the area 100 by the end user 200 before opening the package 306 by the end user 200, after receipt thereof. After opening the package 306, the end user 200 removes the set of corner legs 322 having the set of posts 324 (or any individual leg 322 or post 324), the intermediate leg 326, the fastener 328, and the set of fasteners 334 (or any individual fastener 334) from the package 306. However, note that such packaging configuration is not required. For example, at least one of the set of corner legs 322 having the set of posts 324 (or any individual leg 322 or post 324), the intermediate leg 326, the fastener 328, and the set of fasteners 334 (or any individual fastener 334) can be omitted from the package 306 and be shipped separately. Likewise, at least two of the set of corner legs 322 having the set of posts 324 (or any individual leg 322 or post 324), the intermediate leg 326, the fastener 328, and the set of fasteners 334 (or any individual fastener 334) can be in a package, whether the package contains other components of the kit 300 (e.g., the headboard 310, the head rail 314, the side rail 316, the foot rail 318, the side rail 320) or not. Similarly, some or each of the set of corner legs 322 having the set of posts 324 (or any individual leg 322 or post 324), the intermediate leg 326, the fastener 328, and the set of fasteners 334 (or any individual fastener 334) can be shipped in its own package.

Although the set of posts 324 extends from the set of corner legs 322 before sending to the end user 200, this is not required and the end user 200 can assemble (e.g., adhere, fasten, mate) at least some of the set of posts 324 with the set of corner legs 322 in the area 100. Although the set of posts 332 extends from the intermediate rail 330 before sending to the end user 200, this is not required and the end user 200 can assemble (e.g., adhere, fasten, mate) at least some of the posts 332 with the intermediate rail 330 in the area 100.

The package 308 contained a pair of rolls of slats 336 when shipped (e.g., sent) by the provider thereof to the end user 200 via a governmental mail service (e.g., USPS) or a common courier (e.g., UPS, FedEx, DHL) and deposited in the area 100 by the end user 200 before opening the package 308 by the end user 200, after receipt thereof. Some or each roll of slats 336 in the pair of rolls of slats 336 can be rolled or folded in the package 308 during shipping, to be unrolled or unfolded by the end user 200 in the area 100, as further described below. Note that the pair of rolls of slats 336 (including slats, webbing or other individual components) can also be shipped by the provider individually, in separate packages, whether component-by-component, slat-by-slat, set of slats-by-set of slats, or slat roll-by-slat roll, whether those packages contain other components of the kit 300 (e.g., the headboard 310, the head rail 314, the side rail 316, the foot rail 318, the side rail 320) or not. For example, the package 308 may contain a pair of webbing strips and a set of individual slats 336 that are disconnected or detached from each other and the end user 200 may assemble those webbing strips and those slats 336 to be the roll of slats 336 in the area 100.

Therefore, the provider of the kit 300 can send the kit 300 to the end user 200, where the kit includes the head rail 314, the foot rail 318, the side rail 316, the side rail 318, the intermediate rail 330, the corner leg 322, the slat 336, the post 324, and the second post 332 to the end user 200. For example, the kit 300 may be packaged at any foregoing including suitable combinations thereof. At least two of the head rail 314, the foot rail 318, the side rail 316, the side rail 320, the intermediate rail 330, the corner leg 322, the slat 336, the post 324, or the post 332 may be packaged in a package being sent to the end user 200. At least three of the head rail 314, the foot rail 318, the side rail 316, the side rail 320, the intermediate rail 330, the corner leg 322, the slat 336, the post 324, or the post 332 may be packaged in the package being sent to the end user 200. At least four of the head rail 314, the foot rail 318, the side rail 316, the side rail 320, the intermediate rail 330, the corner leg 322, the slat 336, the post 324, or the post 332 may be packaged in the package being sent to the end user 200. At least five of the head rail 314, the foot rail 318, the side rail 316, the side rail 320, the intermediate rail 330, the corner leg 322, the slat 336, the post 324, or the post 332 may be packaged in the package being sent to the end user 200. At least six of the head rail 314, the foot rail 318, the side rail 316, the side rail 320, the intermediate rail 330, the corner leg 322, the slat 336, the post 324, or the post 332 may be packaged in the package being sent to the end user 200. The head rail 314 and the foot rail 318 may be packaged in a package sent to the end user 200. The head rail 314 may be packaged in a first package and the foot rail 318 may be packaged in a second package sent to the end user 200. The side rail 316 and the side rail 320 may be packaged in a package sent to the end user 200. The side rail 316 may be packaged in a first package and the side rail 320 may be packaged in a second package sent to the end user 200. The corner leg 322 and the post 324 may be packaged in a package sent to the end user 200. The package may be packaged not contain the head rail 314, the foot rail 318, the side rail 316, the side rail 320, or the intermediate rail 330. The corner leg 322 and the slat 336 may be packaged in a package sent to the end user 200. The corner leg 322 may be packaged in a first package and the slat 336 is packaged in a second package sent to the end user 200.

Figure 2:
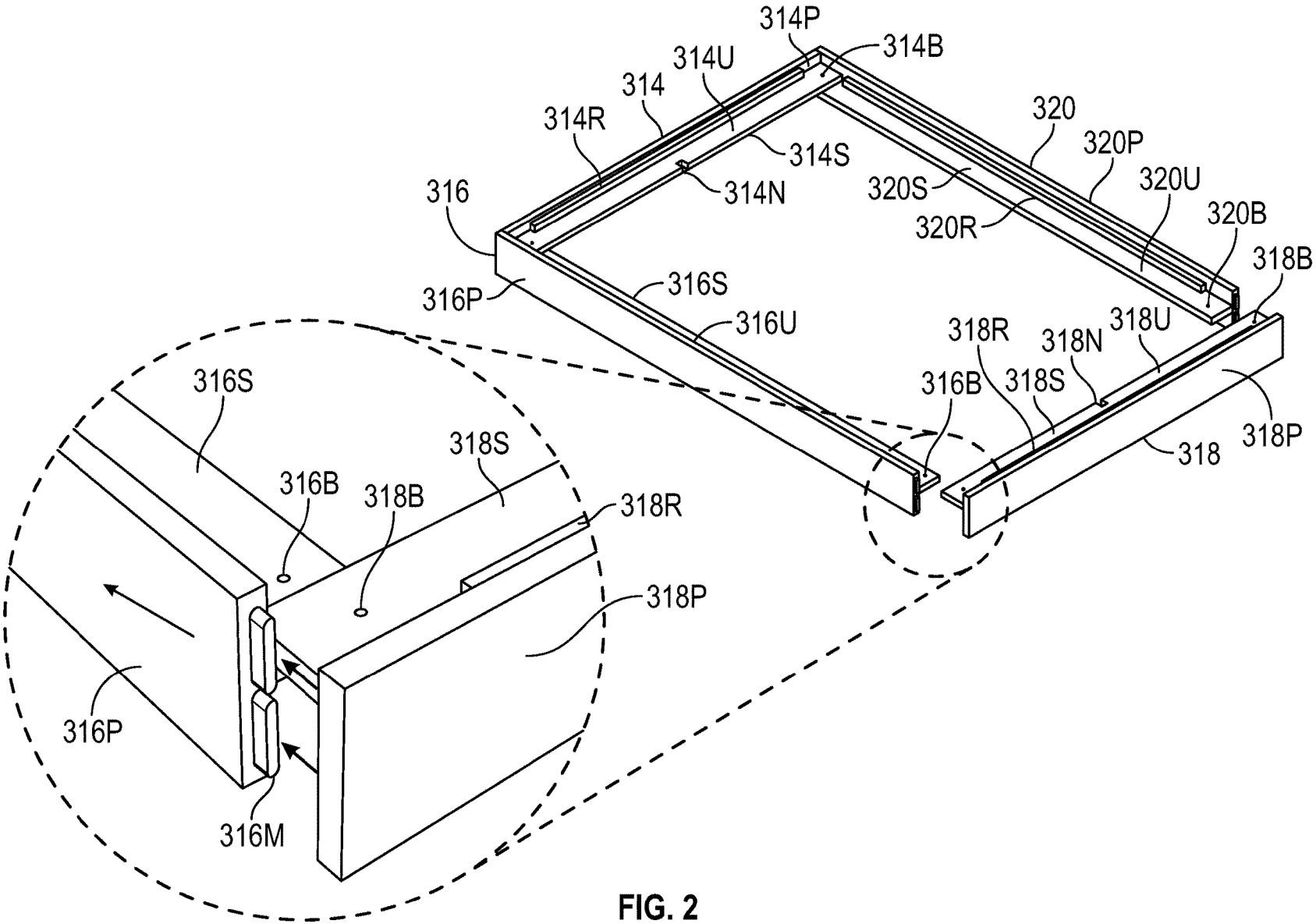
FIG. 2 shows an example of a head rail, a foot rail, a first side rail, and a second side rail according to this disclosure.

FIG. 2 shows an example of a head rail, a foot rail, a first side rail, and a second side rail according to this disclosure. In particular, the kit 300 is used to assemble a polygonal shape (e.g., a rectangle) via the head rail 314, the side rail 316, the foot rail 318, and the side rail 320.

The head rail 314 is T-shaped end-to-end, as defined via a platform 314P and a shelf 314S, although such shaping is not required (e.g., L-shaped or I-shaped) or such extension is not required (e.g., segments). The head rail 314 includes a rod 314R (bar) extending along the platform 314P and the shelf 314S. The shelf 314S includes a notch 314N and a pair of bores 314B. The head rail 314 includes an underside 314U and an overside. The head rail 314 includes a mating interface (e.g., a male portion, a female portion) 314M. For example, the male portion can include a projection (e.g., a tooth) and a female portion can include a depression (e.g., a well, a slot) configured to receive the projection. As shown in FIG. 2, the underside 314U faces the end user 200 as the head rail 314 opposes the foot rail 318 and the head rail 314 forms a U-shape with the side rail 316 and the side rail 320.

The foot rail 318 is T-shaped end-to-end, as defined via a platform 318P and a shelf 318S, although such shaping is not required (e.g., L-shaped or I-shaped) or such extension is not required (e.g., segments). The foot rail 318 includes a rod 318R (bar) extending along the platform 318P and the shelf 318S. The shelf 318S includes a notch 318N and a pair of bores 318B. The foot rail 318 includes an underside 318U and an overside. The foot rail 318 includes a mating interface (e.g., a male portion, a female portion) 318M. For example, the male portion can include a projection (e.g., a tooth) and a female portion can include a depression (e.g., a well, a slot) configured to receive the projection. As shown in FIG. 2, the underside 318U faces the end user 200 as the head rail 314 opposes the foot rail 318 and the foot rail 314 forms a U-shape with the side rail 316 and the side rail 320.

The side rail 316 is T-shaped end-to-end, as defined via a platform 316P and a shelf 316S, although such shaping is not required (e.g., L-shaped or I-shaped) or such extension is not required (e.g., segments). The side rail 316 includes a rod 316R (bar) extending along the platform 316P and the shelf 316S. The shelf 316S includes a pair of bores 316B. The side rail 318 includes an underside 318U and an overside. The side rail 316 includes a mating interface (e.g., a male portion, a female portion) 316M. For example, the male portion can include a projection (e.g., a tooth) and a female portion can include a depression (e.g., a well, a slot) configured to receive the projection. As shown in FIG. 2, the underside 316U faces the end user 200 as the head rail 314 opposes the foot rail 318 and the head rail 314 or the foot rail 318 forms a U-shape with the side rail 316 and the side rail 320.

The side rail 320 is T-shaped end-to-end, as defined via a platform 320P and a shelf 320S, although such shaping is not required (e.g., L-shaped or I-shaped) or such extension is not required (e.g., segments). The side rail 320 includes a rod 320R (bar) extending along the platform 320P and the shelf 320S. The shelf 320S includes a pair of bores 320B. The side rail 320 includes an underside 320U and an overside. The side rail 320 includes a mating interface (e.g., a male portion, a female portion) 320M. For example, the male portion can include a projection (e.g., a tooth) and a female portion can include a depression (e.g., a well, a slot) configured to receive the projection. As shown in FIG. 2, the underside 320U faces the end user 200 as the head rail 314 opposes the foot rail 318 and the head rail 314 or the foot rail 318 forms a U-shape with the side rail 316 and the side rail 320.

Therefore, (i) the head rail 314 can mate with the side rail 316 or the side rail 320 or (ii) the foot rail 318 can mate with the side rail 316 or the side rail 320. For example, as shown in FIG. 2, the head rail 314 or the foot rail 318 includes a first sidewall with a first mating interface and the side rail 316 or the side rail 320 includes a second sidewall with a second mating interface. Accordingly, (i) the head rail 314 mates with the side rail 316 or the side rail 320 via the first mating interface and the second mating interface or (ii) the foot rail 318 mates with the side rail 316 or the side rail 320 via the first mating interface and the second mating interface. As shown in FIG. 2, the first sidewall may face the second sidewall as the first mating interface faces the second mating interface. Note that the head rail 314 or the foot rail 318 may not be T-shaped or L-shaped end-to-end. Likewise, the side rail 316 or the side rail 320 may not be T-shaped or L-shaped end-to-end. Similarly, the intermediate rail 330 may not be T-shaped or L-shaped end-to-end.

Figure 3:
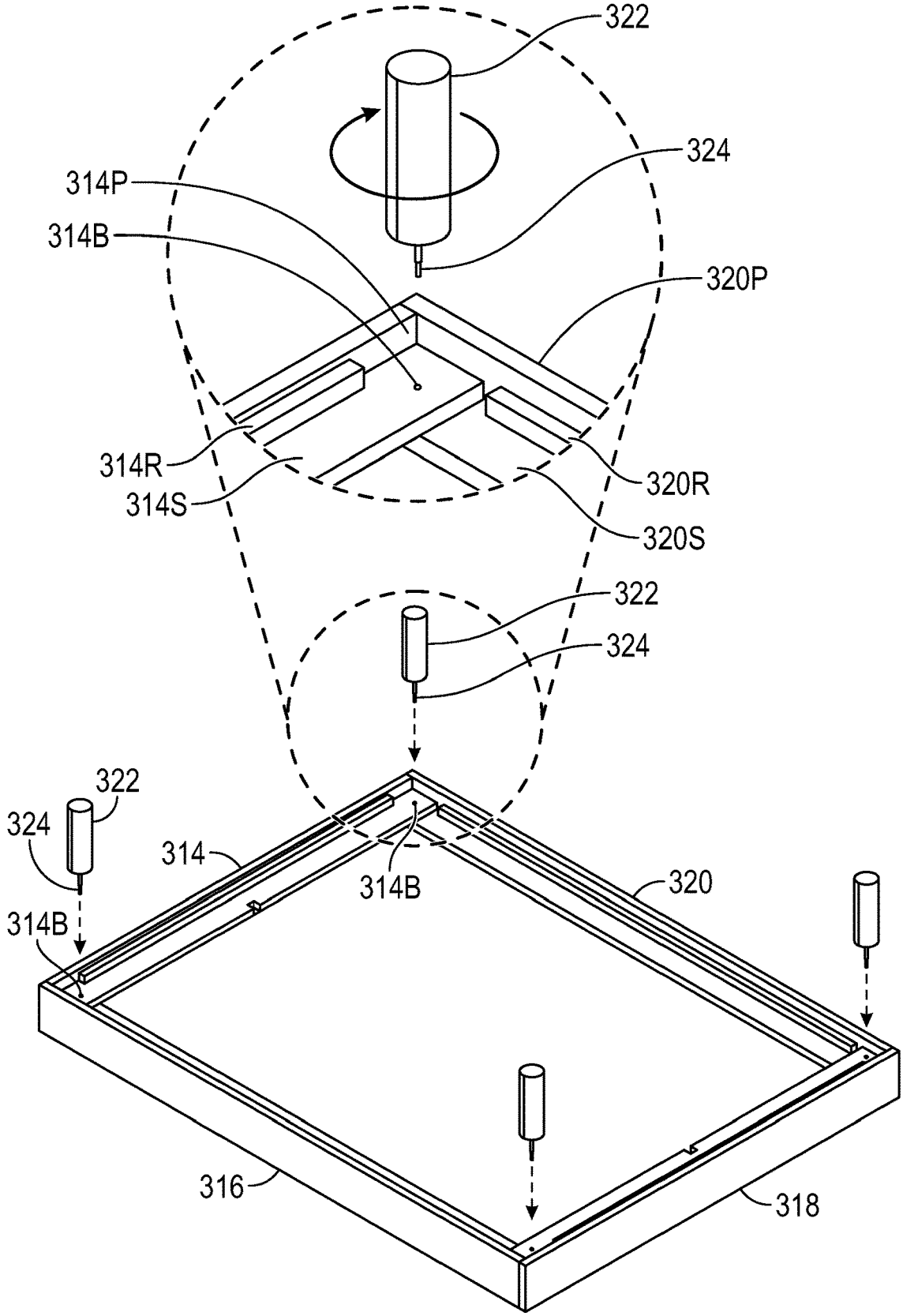
FIG. 3 shows an example a corner leg according to this disclosure.

FIG. 3 shows an example a corner leg according to this disclosure. In particular, the polygonal shape of FIG. 2 receives the set of posts 324 extends from the set of corner legs 322 while the underside 314U, the underside 318U, the underside 316U, and the underside 318U face the end user 200, such that the set of posts 324 extends in the bores 314B, 316B, 318B, and 320B, which may be internally threaded or internally smooth. Therefore, some or each post in the set of posts 324 may have a sidewall that is externally threaded or externally smooth, such that the set of posts 324 secure the polygonal shape to persist in its shape (e.g., rectangular). Note that the set of posts 324 extends from the set of corner legs 322, whether sent in that configuration by the provider thereof to the end user 200 or whether the end user 200 assembled (e.g., mated, adhered, fastened, magnetized) the set of posts 324 to extend from the set of corner legs 322 in the area 100.

As shown in FIGS. 2-3, the head rail 314 or the foot rail 318 is T-shaped or L-shaped and the side rail 316 or the side rail 320 is T-shaped or L-shaped. Therefore, the head rail 314 or the foot rail 318 underlaps or overlaps the side rail 316 or the side rail 320 while the post 324 extends in (i) the head rail 314 and the side rail 316 or the side rail 320 or (ii) the foot rail 318 and the side rail 314 or the side rail 20 as the post 324 extends from the corner leg 322.

As shown in FIGS. 2-3, the head rail 314 or the foot rail 318 may be T-shaped or L-shaped as defined via the shelf 314S or 318S and the platform 314P or 318P, where the head rail 314 or the foot rail 318 includes a rod (bar) 314R or 318R extending along the shelf 314S or 318S and the platform 314P or 318P between the head rail 314 and the foot rail 318. The rod 314R or 318R may be omitted. The shelf 314S or 318P may have a top side and a bottom side (314U or 318U), where the intermediate rail 330 rests on the top side and the rod 314R or 318R extends on the bottom side (314U or 318U). The rod 314R or 318R may not span between the side rail 316 and the side rail 320. Similarly, the side rail 316 and the side rail 320 may have the rod 316R or 320R, where the rod 316R or 320R spans between the platform 314P and the platform 318P. The rod 316R or 320R may be omitted.

Figure 4:
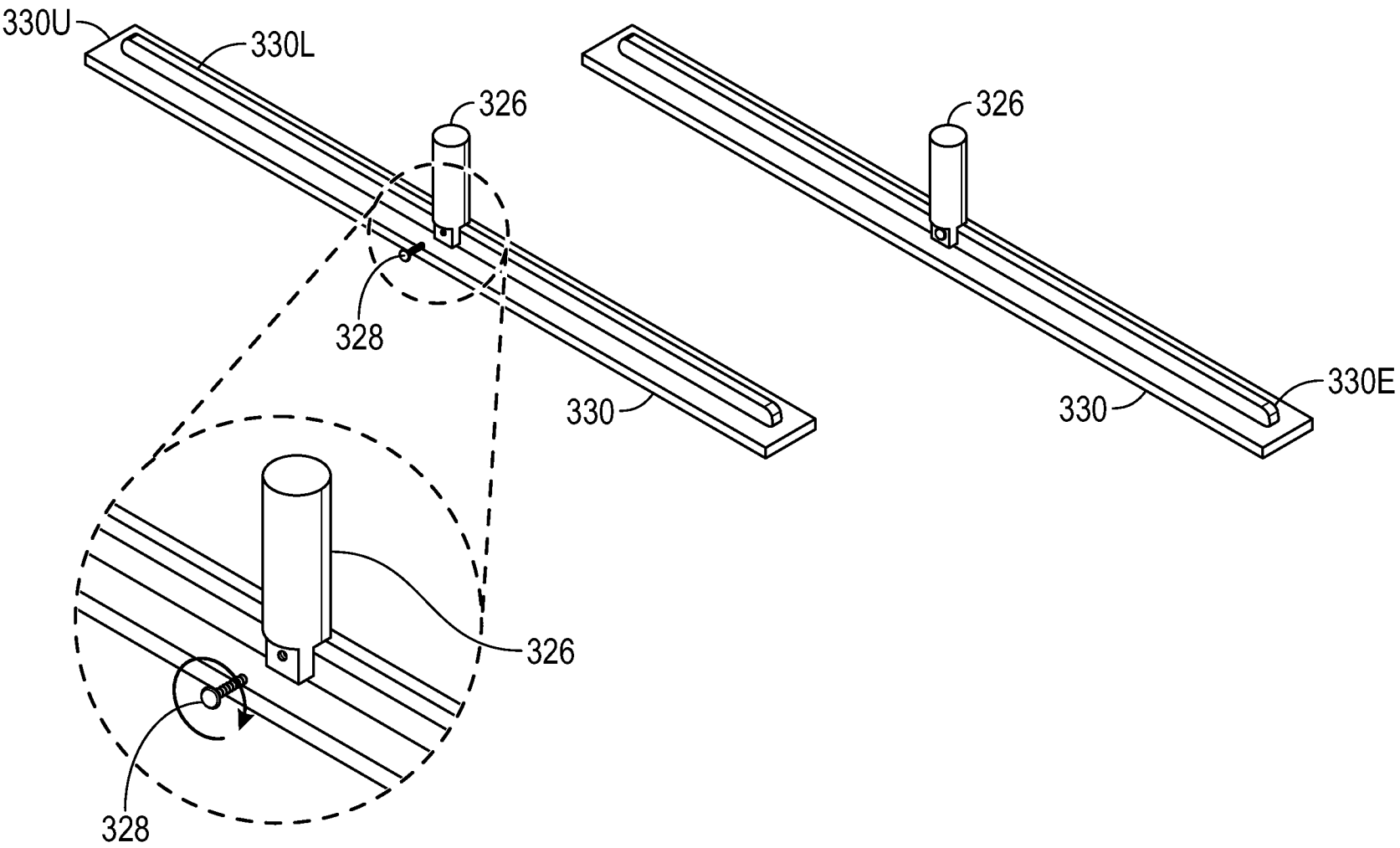
FIG. 4 shows an example of an intermediate rail and an intermediate leg according to this disclosure.

FIG. 4 shows an example of an intermediate rail and an intermediate leg according to this disclosure. In particular, the intermediate rail 330 includes a lower portion 330L and an upper portion 300U extending from the lower portion 300L. The lower portion 330L has a pair of end portions 330E offset relative to the upper portion 330L such that the end portions 330E are obtusely or acutely angled relative to the upper portion 330L. The lower portion 330L may be T-shaped with the upper portion 330U.

The upper portion 330L may underlap or overlap the head rail 314 or the foot rail 318 while (i) the post 324 extends in the slat 336 as the corner leg 322 supports the head rail 314 or the foot rail 318 and (ii) the post 332 extends in the slat 336 as the post 332 extends from the intermediate rail 330. The lower portion 330L may have the end portion 330E that is obtusely or acutely angled relative to the upper portion 330L.

The intermediate leg 326 has a U-shaped portion through which the lower portion 330L extends, while the U-shaped portion engages (e.g., contacts) the upper portion 330L. For example, when the intermediate leg 326 has a U-shaped portion, a C-shaped portion, or a V-shaped portion, the intermediate rail 330 can extend therethrough. Although such configuration may be sufficient for some use cases, the end user 200 can insert the fastener 328 through the U-shaped portion and the lower portion 330L to secure the intermediate leg 326 to the intermediate rail 326. The lower portion 330L can face the end user 200 for enabling the end user 200 to extend the fastener 328 through the U-shaped portion of the intermediate leg 326.

Therefore, when the provider sends the intermediate leg 330 to the end user 200, the provider can cause (e.g., instruct, teach) the end user 200 to have the intermediate rail 330 be supported by the intermediate leg 326 while the post 324 extends in the slat 336 and the post 332 extends in the slat 336. Although the intermediate leg 326 extends from the intermediate rail 330 before sending to the end user 200, this is not required and the end user 200 can assemble (e.g., adhere, fasten, mate) at least the intermediate leg 326 with the intermediate rail 330 in the area 100. The intermediate leg 326 supports the intermediate rail 330 between the head rail 314 and the foot rail 318. The intermediate rail 330 extends through the intermediate leg 326. The intermediate leg 326 and the intermediate rail 320 are fastened, but can be mated.

Figure 5:
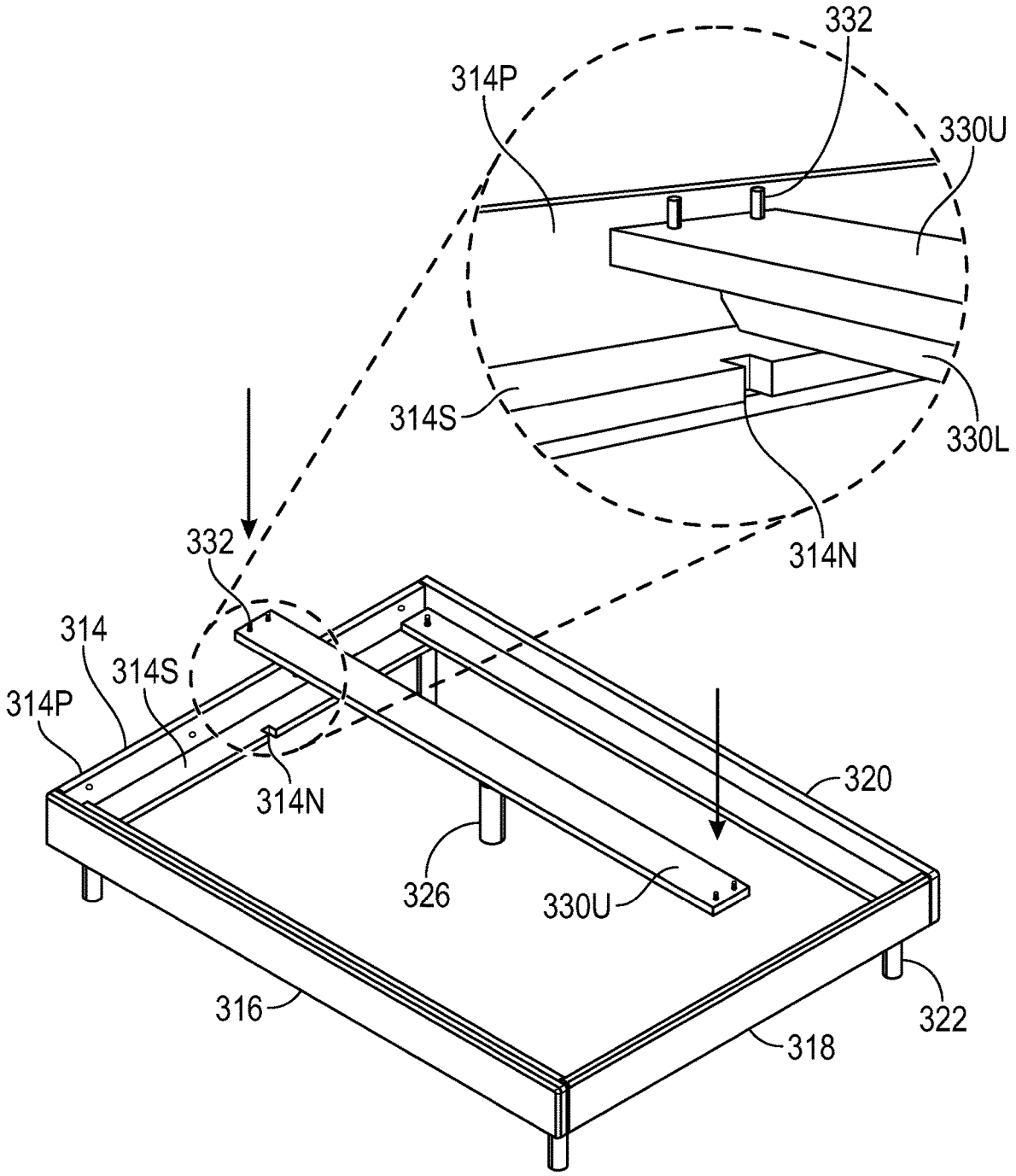
FIG. 5 shows an example of an intermediate rail engaging a head rail or a foot rail according to this disclosure.

FIG. 5 shows an example of an intermediate rail engaging a head rail or a foot rail according to this disclosure. In particular, the head rail 314, the foot rail 318, the side rail 316, and the side rail 320 persisting in the polygonal shape, as secured by the set of posts 324 extends from the set of corner legs 322. Therefore, the polygonal shape may be flipped by the end user 200 (alone or with agent) to be upright such that the underside 314U, the underside 318U, the underside 316U, and the underside 318U avoid facing the end user 200 and the set of corner legs 322 supports the head rail 314, the foot rail 318, the side rail 316, and the side rail 320 persisting in the polygonal shape, as secured by the set of posts 324 extends from the set of corner legs 322, which may be toward the end user 200. The fastener 328 can be extended through the U-shaped portion before or after flipping the polygonal by the end user 200 (alone or with agent) to be upright. Once flipped, the intermediate rail 330 is deposited on the polygonal shape such that the intermediate leg 326 supports the intermediate rail 330, while the upper portion 330L rests on the shelf 314S and the shelf 318S between the side rail 316 and the side rail 320. Since the end portion of the lower portion 330L is offset relative to the upper portion 330U to be obtusely or acutely angled relative to the upper portion 330L, the lower portion 330L extends in the notch 314N and the notch 318N, which may allow the upper portion 330U to span between the head rail 314 and the foot rail 318, whether between 314P and 318P or 314S and 318S. Note that the set of posts 332 extends from the intermediate rail 330, whether sent in that configuration by the provider thereof to the end user 200 or whether the end user 200 assembled (e.g., mated, adhered, fastened, magnetized) the set of posts 332 to extend from the intermediate rail 330 in the area 100.

Accordingly, the post 324 may extend in (i) the head rail 314 and the side rail 316 or the side rail 320 or (ii) the foot rail 318 and the side rail 316 or the side rail 230 as the post 324 extends from the corner leg 322 while the head rail 314, the foot rail 318, the side rail 316, or the side rail 320 is upside-down and the underside 314U, the underside 318U, the underside 316U, and the underside 318U face the end user 200. As such, the corner leg 322 may avoid supporting the head rail 314 or the foot rail 318. The end user 200 may flip the head rail 314, the foot rail 318, the side rail 316, or the side rail 320 from being upside-down, as shown in FIGS. 2-3, to be upright, as shown in FIG. 5, such that the corner leg 322 supports the head rail 314 or the foot rail 318 before the slat 336 is deposited on the intermediate rail 330 and the side rail 316 or the side rail 320. However, note that flipping the polygonal shape persisted by the head rail 314, the foot rail 318, the side rail 316, and the side rail 320 is not required and the polygonal shape can be assembled to be upright as persisted by the head rail 314, the foot rail 318, the side rail 316, and the side rail 320.

The head rail 314 or the foot rail 318 includes the shelf 314S or 318S having the notch 314N or the 318N, which may include a bore. The intermediate rail 330 includes the lower portion 330L extending in the notch 314N or 318N as the intermediate rail 330 spans between the head rail 314 and the foot rail 318 such that the intermediate rail 330 extends between the side rail 316 and the side rail 320. The lower portion 330, the notch 314N or 318N may avoid facing the post 332 as the intermediate rail 330 spans between the head rail 314 and the foot rail 318 such that the intermediate rail 330 extends between the side rail 316 and the side rail 320. Although the shelf 314S or 318S may include the notch 314N or 318N, this is not required and the shelf 314S or 318S may be omitted or the notch 314N or the 318N may be omitted. The upper portion 330 may rest on the shelf 314S or 318S as the intermediate rail 330 spans between the head rail 314 and the foot rail 318 such that the intermediate rail 330 extends between the side rail 316 and the side rail 320. The lower portion 330L may avoid the post 332.

Figure 6:
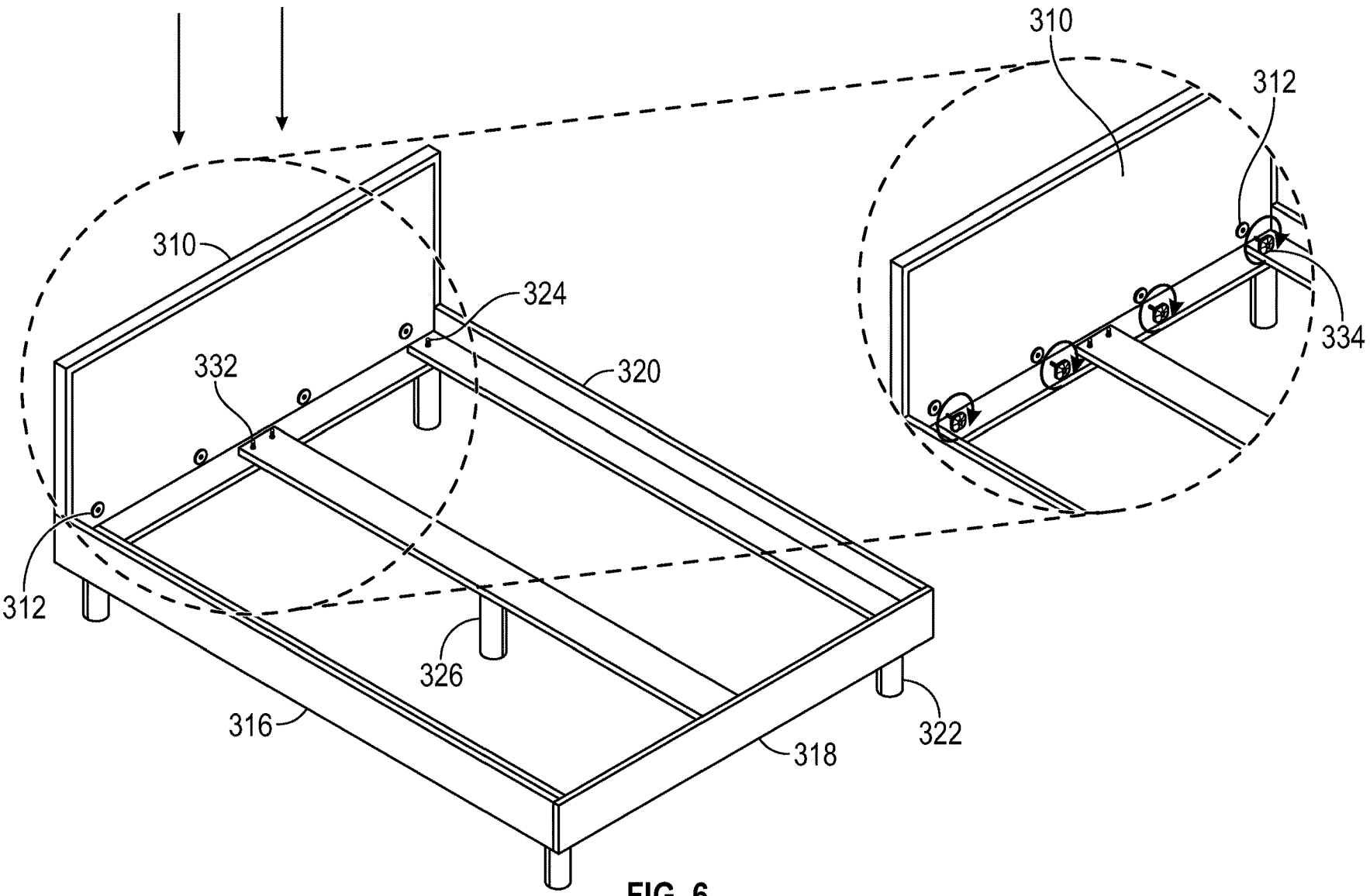
FIG. 6 shows an example of a headboard according to this disclosure.

FIG. 6 shows an example of a headboard according to this disclosure. In particular, if available, the headboard 310 is attached to the head rail 314 via the set of fasteners 334 extending into the set of bores 312 and the head rail 314 such that the underside 314U, the underside 318U, the underside 316U, and the underside 318U avoid facing the end user 200 and the set of corner legs 322 supports the head rail 314, the foot rail 318, the side rail 316, and the side rail 320 persisting in the polygonal shape, as secured by the set of posts 324 extends from the set of corner legs 322, which may be toward the end user 200. Note that other ways of attaching the headboard 310 to the head rail 314 are possible (e.g., adhering, magnetizing, mating). The headboard 310 or the set of bores 312 is exposed to the foot rail 318, whether the platform 318P or the shelf 318S. The headboard 310 is exposed to the upper portion 330U of the intermediate rail 330. The headboard 310 is exposed to the set of posts 332. The headboard 310 spans between the side rail 316 and the side rail 318, although this configuration is not required.

As shown in FIG. 6, the head rail 314 and the foot rail 318 are not interchangeable, which may be due to the set of bores 312. However, this configuration is not required and the head rail 314 and the foot rail may be interchangeable 320. Likewise, the side rail 316 and the side rail 320 are interchangeable. However, this configuration is not required and the side rail 316 and the side rail 320 are not interchangeable.

Therefore, the headboard 310 may not be sent to the end user 200, even if the headboard 310 is configured to attach to the head rail 314. For example, the provider does not send the headboard 310 to the end user 200, even though one is available, as the end user 200 did not request. However, when the end user 200 requests the headboard 310, then the provider can send the headboard 310 to the end user 200. The headboard 310 may be attached to the head rail 314 by fastening. For example, the provider may send the fastener 334 (e.g., a hand screw) to the end user 200 and cause (e.g., instruct, teach) the end user 200 to attach the headboard 310 to the head rail 314 by fastening the fastener 334 to the headboard 310 or the head rail 314. The fastener 334 may have a head having a top side opposing the foot rail when fastened to the headboard 310. The headboard 310 may contacts the side rail 316 or the side rail 320, although this configuration is not required and such contact may be possible. The headboard 310 may avoid contact with the intermediate rail 330, although this configuration is not required and such contact may be possible. The headboard 310 may be attached to the head rail 314 before the slat 336 is deposited, although this configuration is not required and the headboard 310 may be attached to the head rail 314 after the slat 336 is deposited. The headboard 310 may span between the side rail 316 and the side rail 318, although this configuration is not required and such span may be avoided. The intermediate rail 330 has a first lateral side and a second lateral side, where the first lateral side opposes the side rail 316 and the second lateral side opposes the side rail 320. As shown in FIG. 2, the headboard 310 may be attached to the head rail 314 at a first point between the side rail 314 and the first lateral side and a second point between the side rail 320 and the second lateral side. The headboard may be attached to the head rail without any hand tools, although this configuration is not required and some tools may be used (e.g., a screwdriver).

Figure 7A:
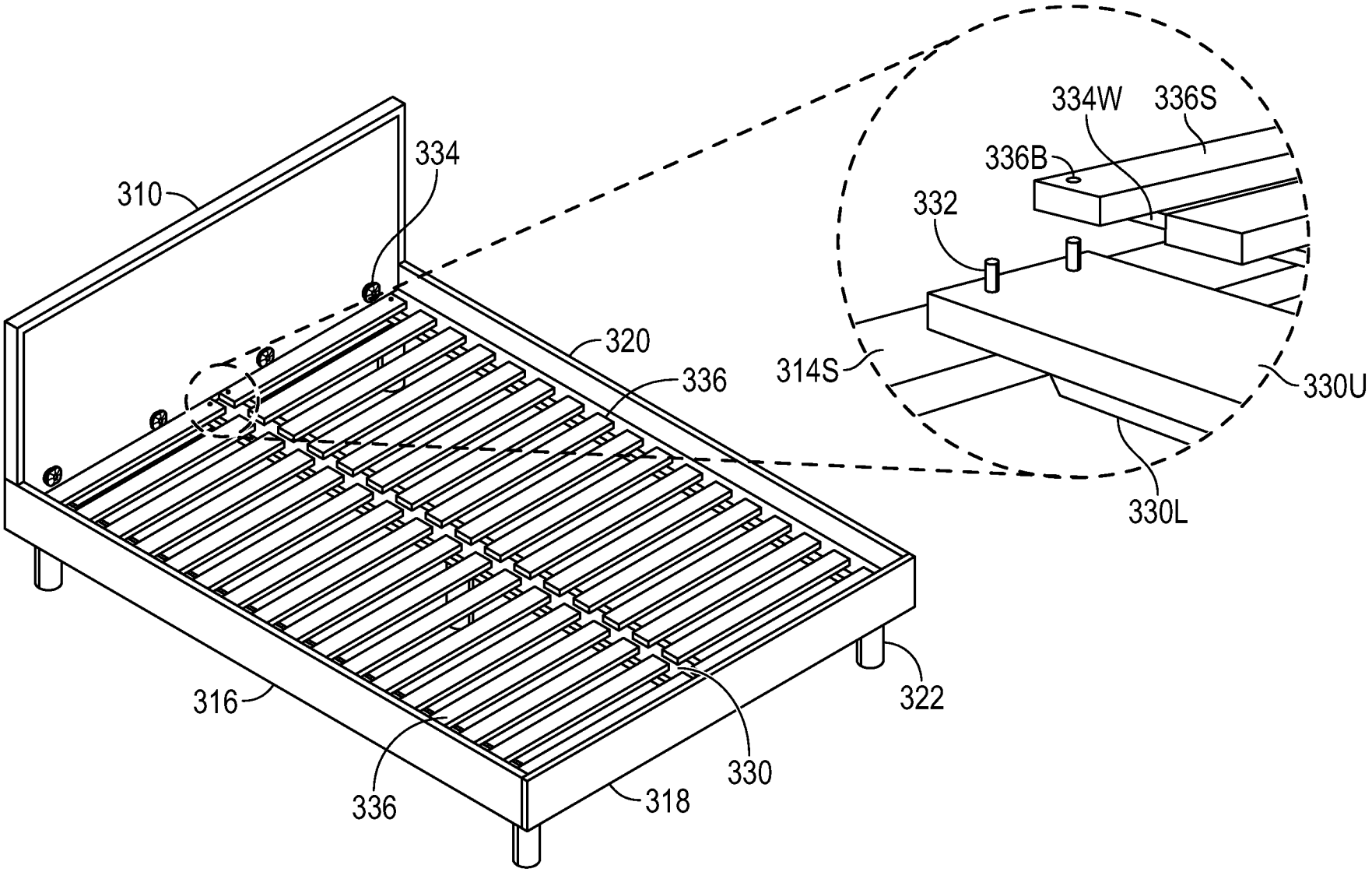
FIG. 7A shows an example of a slat according to this disclosure.

FIG. 7A shows an example of a slat according to this disclosure. In particular, each roll of slats in the pair of rolls of slats 336 includes a first slat 336S, a last slat 336S, and a group of slats in-between, connected to a pair of webbing strips 336W. Each of the first slat 336S and the last slat 336S includes a pair of bores 336B, one of which is configured to receive a post from the set of posts 324 extending from the set of corner legs 322 while extending through the head rail 314 or the foot rail 318 and the side rail 316 or the side rail 320, while another of which is configured to receive a post from the set of posts 332 extending from the upper portion 330U of the intermediate rail 330. Some or each post in the set of posts 324 has a sidewall that is externally smooth or externally threaded in the slat 336. Some or each post in the set of posts 332 has a sidewall that is externally smooth or externally threaded in the slat 336. For example, the slat 336 may have the bore 336B that is internally smooth or internally threaded as the post 324 extends in the bore 336B. Likewise, the slat 336B may have the bore 336B that is internally smooth or internally threaded as the post 332 extends in the bore 336B. As such, each of the first slat 336S and the last slat 336S in each of the pair of rolls of slats 336 can span between the upper portion 330U of the intermediate rail and the side rail 316, whether the shelf 316S or the platform 316P, or the side rail 320, whether the shelf 320S or the platform 320P. Resultantly, the pair of rails of slats 336 can be deposited the upper portion 330U of the intermediate rail 330, the side rail 316, and the side rail 320, while facing the end user 200 to enable a bed frame. Note that other use cases are possible where the first slat 336S or the last slat 336S or another slat in some or each rolls of slats in the pair of rolls of slats 336 lacks the pair of bores 336B. Although the rolls of slats 336 are disclosed, this configuration not required and the sets of slats 336 may be used, whether shipped as interconnected or interconnected by the end user 200 in the area 100, or individual slats 336 may be used, which may be interconnected by the end user 200 in the area 100. The bed frame may be assembled without any hand tools, but this is not required and the bed frame may be assembled with some tools (e.g., a screwdriver).

As shown in FIGS. 3, 5-7A, the head rail 314 or the foot rail 318 may extend between the corner leg 322 and the side rail 316, the side rail 320, or the slat 336. Likewise, the side rail 316 or the side rail 320 may extend between the corner leg 322 and the head rail 314, the foot rail 318, or the slat 336. Similarly, the intermediate rail 330 may extend between the slat 336 and the head rail 314 or the foot rail 318.

As shown in FIG. 7A, the provider can send the pair of rolls of slats 336 to the end user 200 and then cause the end user 200 (e.g., instruct, teach) to deposit the pairs of rolls of slats 336 side-by-side on the intermediate rail 330 and the side rail 316 and the side rail 320 between the head rail 314 and the foot rail 318 as the corner leg 322 supports the head rail 314 or the foot rail 318. The pair of rolls 336 can be deposited by the end user 200 positioning (e.g., unfolding, unrolling) the pairs of rolls of slats 336 to rest on the intermediate rail 330 and the side rail 316 or the side rail 320 between the head rail 314 and the foot rail 318.

Therefore, the provider of the kit 300 can cause (e.g., instruct, teach) the end user 200 to span (i) the side rail 316 between the head rail 314 and the foot rail 318 and (ii) the side rail 320 be-tween the head rail 314 and the foot rail 318; extend the post 324 in (i) the head rail 314 and the side rail 316 or the side rail 320 or (ii) the foot rail 318 and the side rail 316 or the side rail 320 as the post 324 extends from the corner leg 322; span the intermediate rail 330 between the head rail 314 and the foot rail 318 such that the intermediate rail 330 extends between the side rail 316 and the side rail 320; and deposit the slat 336 on the intermediate rail 330 and the side rail 316 or the side rail 320 between the head rail 314 and the foot rail 318 such that (i) the post 324 extends in the slat 336 as the corner leg 322 supports the head rail 314 or the foot rail 318 and (ii) the post 332 extends in the slat 336 as the post 332 extends from the intermediate rail 330.

Likewise, the kit 300 can enable the end user 200 to access the head rail 314, the foot rail 318, the side rail 316, the side rail 320, the inter-mediate rail 330, the corner leg 322, the slat 336, the post 324, and the post 332; span (i) the side rail 316 between the head rail 314 and the foot rail 318 and (ii) the side rail 320 between the head rail 314 and the foot rail 318; extend the post 324 in (i) the head rail 314 and the side rail 316 or the side rail 320 or (ii) the foot rail 318 and the side rail 316 or the side rail 320 as the 324 post extends from the corner leg 322; span the intermediate rail 330 between the head rail 314 and the foot rail 320 such that the intermediate rail 330 extends between the side rail 316 and the side rail 320; and deposit the slat 336 on the intermediate rail 330 and the side rail 316 or the side rail 320 between the head rail 314 and the foot rail 318 such that (i) the post 324 extends in the slat 336 as the corner leg 322 supports the head rail 314 or the foot rail 318 and (ii) the post 332 extends in the slat 336 as the post 332 extends from the intermediate rail 330.

Similarly, the kit 300 can include the head rail 314, the foot rail 318, the side rail 316, the side rail 320, the inter-mediate rail 330, the corner leg 322, the slat 336, the post 324, and the post 332 configured to enable a span of (i) the side rail 316 between the head rail 314 and the foot rail 318 and (ii) the side rail 320 between the head rail 314 and the foot rail 318; an extension of the post 324 in (i) the head rail 314 and the side rail 316 or the side rail 320 or (ii) the foot rail 318 and the side rail 316 or the side rail 320 as the post 324 extends from the corner leg 322; a span of the intermediate rail 330 between the head rail 314 and the foot rail 318 such that the intermediate rail 330 extends between the side rail 316 and the side rail 320; and a deposit of the slat 336 on the intermediate rail 330 and the side rail 316 or the side rail 320 between the head rail 314 and the foot rail 318 such that (i) the post 324 extends in the slat 366 as the corner leg 322 supports the head rail 314 or the foot rail 314 and (ii) the post 332 extends in the slat 336 as the post 332 extends from the intermediate rail 330.

Additionally, the kit 300 can enable the bed frame to be assembled. The bed frame includes the head rail 314, the foot rail 318, the side rail 316, the side rail 320, the inter-mediate rail 330, the corner leg 322, the slat 336, the post 324, and the post 332. The side rail 316 spans between the head rail 314 and the foot rail 320. The side rail 320 spans between the head rail 314 and the foot rail 318. The post 324 extends in (i) the head rail 314 and the side rail 316 or the side rail 320 or (ii) the foot rail 318 and the side rail 316 or the side rail 320 as the post 324 extends from the corner leg 322. The intermediate rail 330 spans between the head rail 314 and the foot rail 318 such that the intermediate rail 330 extends between the side rail 316 and the side rail 320. The slat 336 is deposited on the intermediate rail 330 and the side rail 314 or the side rail 320 between the head rail 314 and the foot rail 318 such that (i) the post 324 extends in the slat 336 as the corner leg 322 supports the head rail 314 or the foot rail 318 and (ii) the post 332 extends in the slat 336 as the post 332 extends from the intermediate rail 330.

Figure 7B:
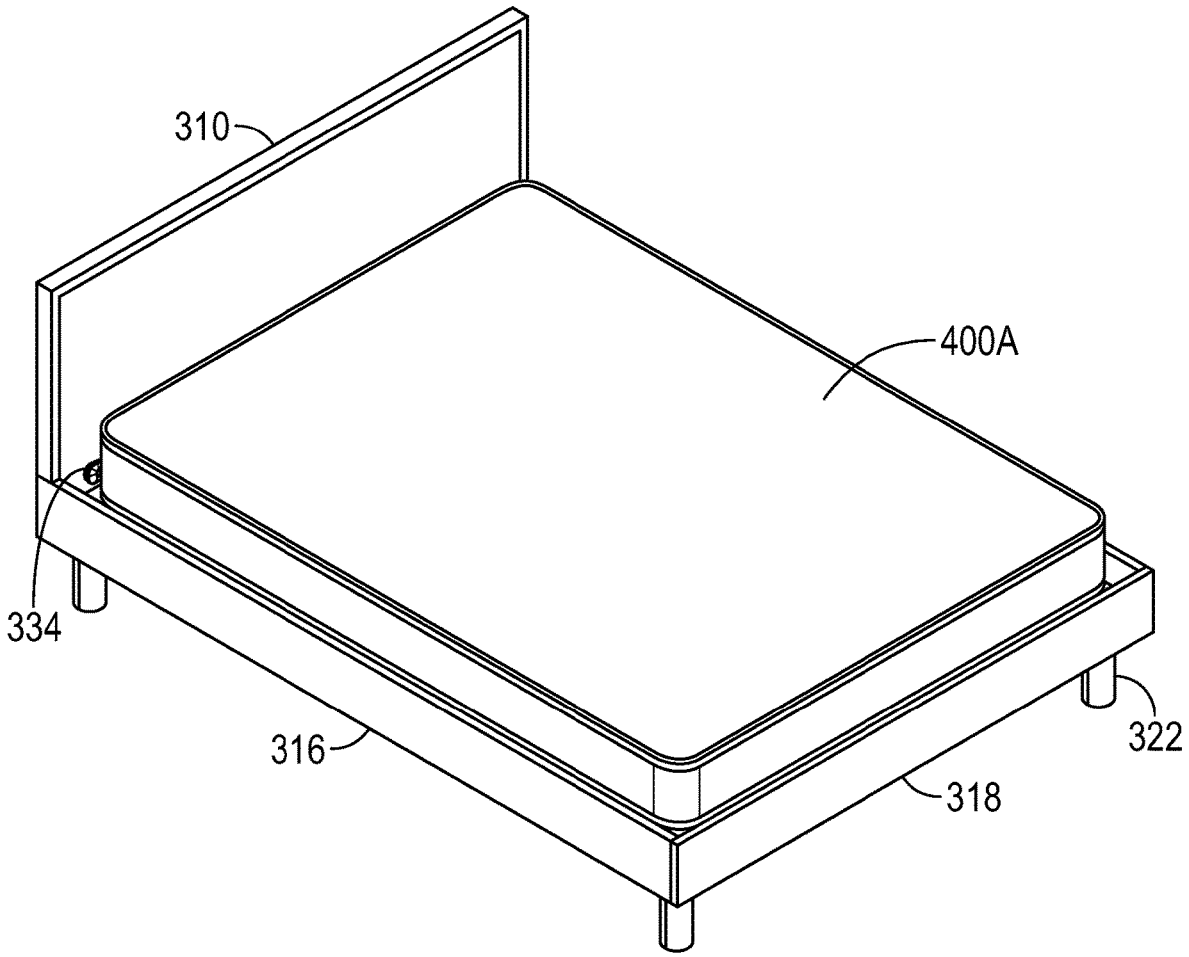
FIG. 7B shows an example of a mattress according to this disclosure.

FIG. 7B shows an example of a mattress according to this disclosure. In particular, if available, there may be a mattress 400A shipped by the provider thereof to the end user 200 and deposited on the bed frame by the end user 200. The mattress 400A rests on or over the pair of rolls of slats 336 or the intermediate rail 330, while exposed to the headboard 310 and the set of fasteners 334. Note that the mattress 400A avoids extending past the side rail 316, the side rail 320, and the foot rail 318, although this configuration is not required. The mattress 400A spans between the head rail 314 and the foot rail 318, although extension past the head rail 314 or the foot rail 318 is possible. The headboard 310, if available, may be exposed to the mattress 400A. The mattress 400A avoids overlapping with the set of corner legs 322, but this is possible.

Figure 7C:
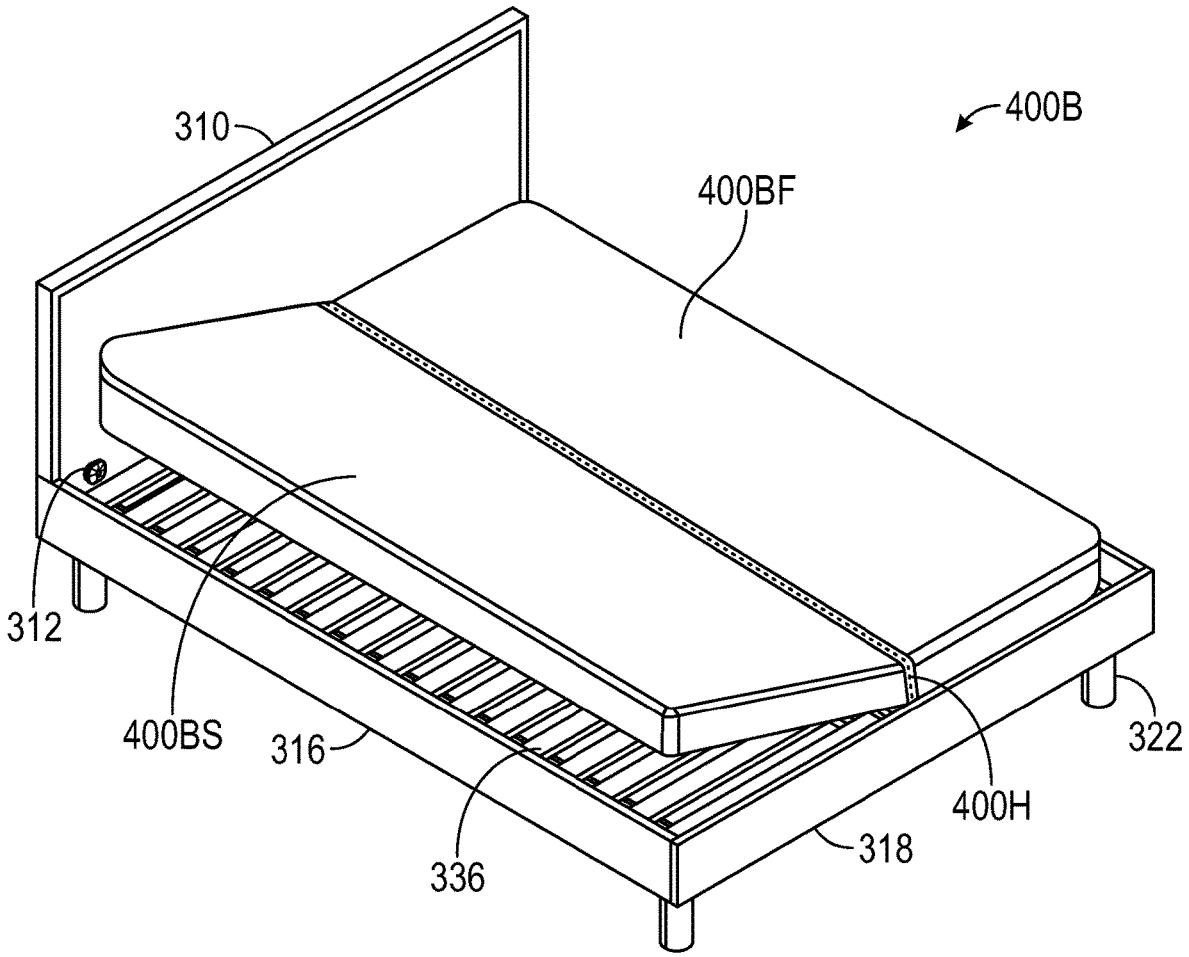
FIG. 7C shows an example of a mattress according to this disclosure.

FIG. 7C shows an example of a mattress according to this disclosure. In particular, unlike the mattress 400A, if available, there may be a mattress 400B, which is similar to the mattress 400A but differs by including a first mattress 400BF, a second mattress 400BS, and a material (e.g., fabric) 400H attached (e.g., stitched), extending, spanning or otherwise coupled to the first mattress 400BF and the second mattress 400BS, whether identically or non-identically, to function as a hinge (e.g., a living hinge, a butterfly hinge), thereby enabling the mattress 400B to switch between a stacked position (closed) and a unstacked position (open). For example, the material 400H may be foldable, bendable, flexible, resilient, or otherwise configured to allow for such switching. In the stacked position, the second mattress 400BS overlaps and rests on the first mattress 400BF, which may or may not be sufficient for sleeping. In the unstacked position, the second mattress 400BS and the first mattress 400BF are positioned side-by-side between the side rail 316 and the side rail 320, although extension past the side rail 316 or the side rail 320 are possible. The material 400H, the first mattress 400BF, and the second mattress 400BS define a common laying surface in the unstacked position, as shown in FIG. 2. The mattress 400B spans between the head rail 314 and the foot rail 318, although extension past the head rail 314 or the foot rail 318 is possible. The material 400H may extend over the upper portion 330U of the intermediate rail 330. There may be an air gap between the material 400H and the upper portion 330U of the intermediate rail 330. The material 400H may be used for the end user 200 to lay on. However, if the mattress 400B is flipped, then there may be the air gap between the first mattress 400BF and the second mattress 400BS. The material 400H may enable a range of pivoting motion of about 180 degrees or less. The second mattress 400BS may have a tab by which the second mattress 400BS is pulled to be hingedly moved between the stacked position and the unstacked position. The first mattress 400BF and second mattress 400BS may or may not be sized, shaped, or constituted to be identical or non-identical.

The headboard 310, if available, may be exposed to the mattress 400B. The mattress 400B avoids overlapping with the set of corner legs 322, but this is possible.

Therefore, if available, the provider may send the mattress 400A or 400B to the end user and cause (e.g., instruct, teach) the end user 200 to position the mattress 400A or 400B such that the slat 336 extends between the intermediate rail 330 and the mattress 400A or 400B. When the mattress is 400B, then the mattress 400B may defined by the first mattress 400BF, the second mattress 400BS, and the hinge 400H spanning between the first mattress 400BF and the second mattress 400BS such that the first mattress 400BF is able to hingedly stack on the second mattress 400BS. The hinge 400H may extends over the intermediate rail 330, but this configuration is not required and the hinge 400H may avoid extending over the intermediate rail 330. Note that the mattress 400A or 400B may not be sent to the end user 200, even if the mattress 400A or 400B is configured to be positioned such that the slat 336 extends between the intermediate rail 330 and the mattress 400A or 400B. For example, the provider does not send the mattress 400A or 400B to the end user 200, even though one is available, as the end user 200 did not request.

Figure 8A:
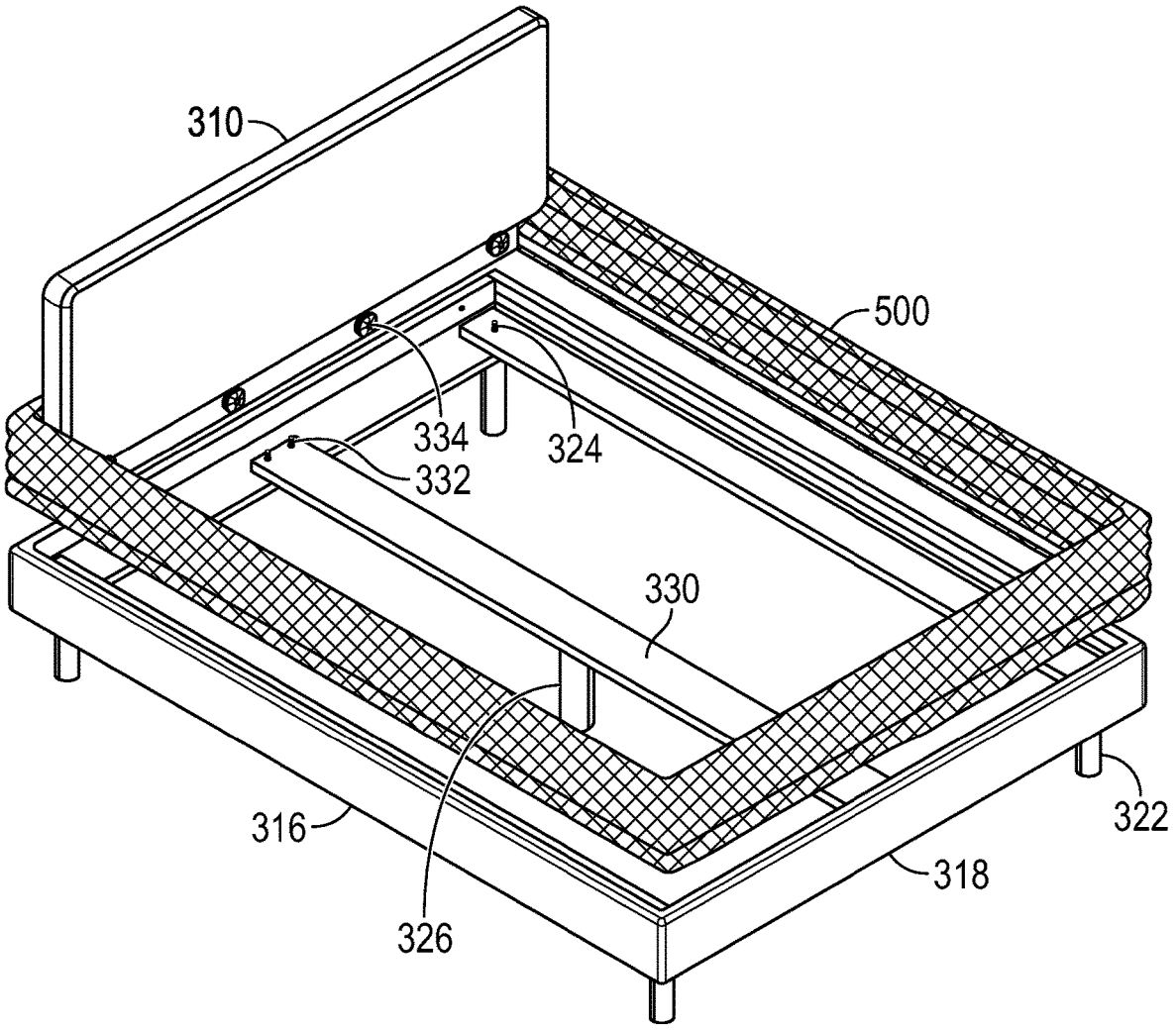
FIG. 8A shows an example of an upholstered cover before being mounted to a bed frame according to this disclosure.
Figure 8B:
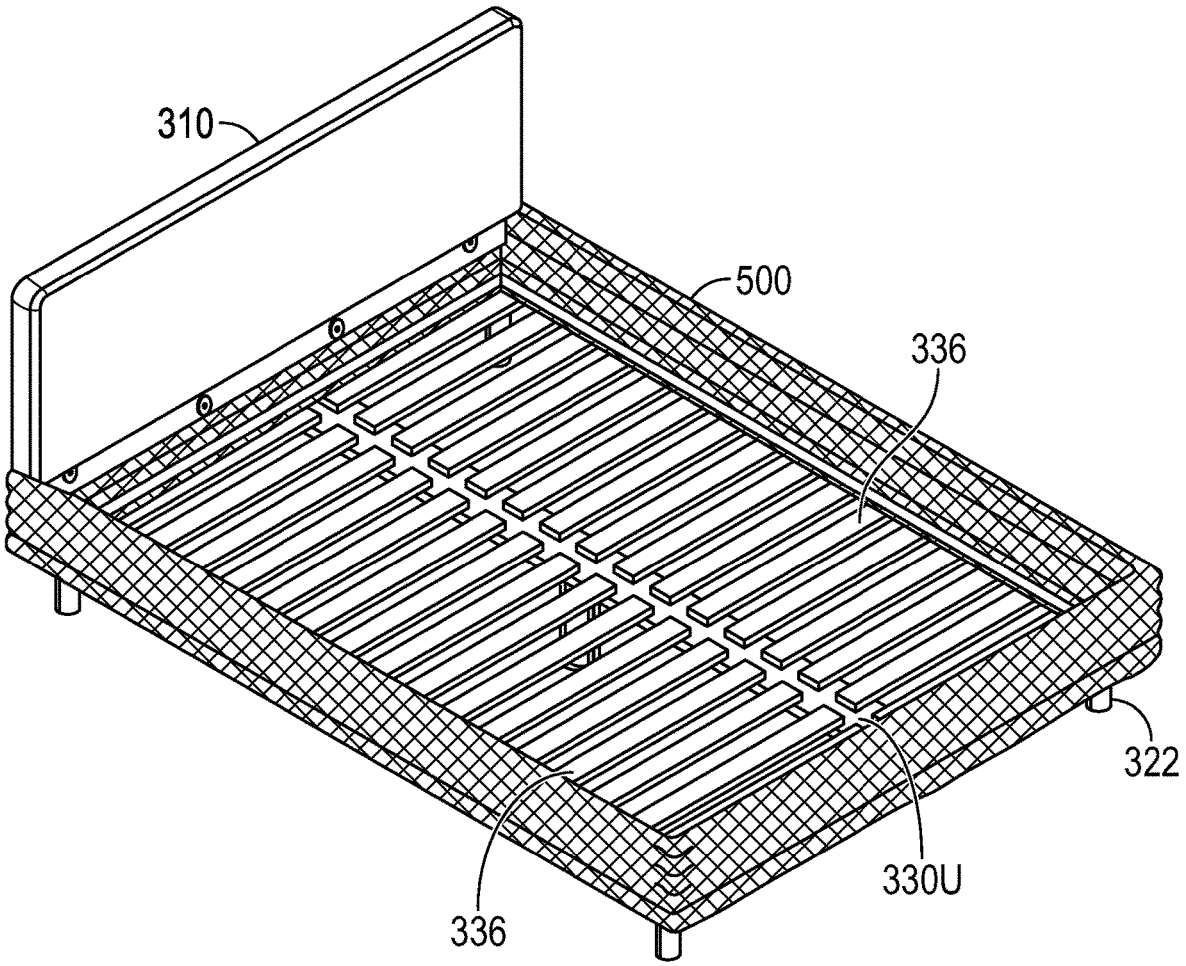
FIG. 8B shows an example of an upholstered cover before after mounted to a bed frame according to this disclosure.

FIG. 8A shows an example of an upholstered cover before being mounted to a bed frame according to this disclosure. FIG. 8B shows an example of an upholstered cover before after mounted to a bed frame according to this disclosure. In particular, if available, there may be an upholstered cover 500 (e.g., fabric, leather), which may match in shape to the polygonal shape when arranged (e.g., stretched) and sized to mount over the bed frame to extend over the head rail 314, the foot rail 318, the side rail 316, and the side rail 318. The upholstered cover 500 may extend along the platform 314P, the platform 318P, the platform 316P, and the platform 320P such that the platform 314P, the platform 318P, the platform 316P, and the platform 320P extend between the upholstered cover 500 and the shelf 314S, the shelf 318S, the shelf 316S, and the shelf 320S. The upholstered cover 500 encloses the intermediate rail 330. If the headboard 310 is available, then the headboard 310 may be enclosed by the upholstered cover 500. The pair of rolls of slats 336 is enclosed by the upholstered cover 500.

Therefore, the provider may send the upholstered cover 500 to the end user 200 and cause (e.g., instruct, teach) the end user 200 to extend the upholstered cover 500 over the side rail 316, the foot rail 318, and the side rail 320. Such extension can be before the slat 336 is deposited, although this configuration is not required and such extension can be after the slat 336 is deposited. However, this configuration is not required. For example, the upholstered cover 500 may not be sent to the end user 200, even if the upholstered cover 500 is configured to extend over the side rail 316, the foot rail 318, and the side rail 320. For example, the provider does not send the upholstered cover 500 to the end user 200, even though one is available, as the end user 200 did not request.

The provider can cause the end user 200 to assemble the kit 300 in various ways. For example, there may be a set of instructions (e.g., a diagram, a photo, a user guide, a manual, a paper pamphlet, a sticker, a webpage, a video, an article, augmented reality wizard) associated with the kit 300 and instructing the end user 200 how to manufacture or use the kit 300, including any of its components. As such, the end user 200 can access the kit 300 and manufacture or use the kit 300, as instructed.

Although various embodiments have been depicted and described in detail herein, skilled artisans know that various modifications, additions, substitutions and the like can be made without departing from this disclosure. As such, these modifications, additions, substitutions and the like are considered to be within this disclosure.

What is claimed is:

1. A kit, comprising:

a corner leg including a post;

a head rail including a head platform and a head shelf, wherein the head shelf extends from the head platform, wherein the head shelf includes a head bore, wherein the head rail is T-shaped end-to-end;

a side rail including a side platform and a side shelf, wherein the side shelf extends from the side platform, wherein the side shelf includes a side bore, wherein the head rail and the side rail can be assembled to form a corner of a frame of a bed by an end user without usage of any hand tools when (a) the head platform contacts the side platform, (b) the head shelf underlaps or overlaps the side shelf, and (c) the post extends into the head bore and the side bore, wherein the side rail is T-shaped end-to-end; and a set of slats restable on the side shelf such that the side platform limits the set of slats in lateral movement when the bed is upright.

2. The kit of claim 1, wherein the head shelf underlaps the side shelf.

3. The kit of claim 1, wherein the head shelf overlaps the side shelf.

4. The kit of claim 1, wherein the head rail and the side rail can be assembled to form the corner of the frame of the bed by the end user without usage of any hand tools before the frame of the bed is flipped by the end user to be upright for the corner leg to support the corner of the frame of the bed.

5. The kit of claim 4, further comprising:

an intermediate rail; and an intermediate leg, wherein the intermediate leg is securable to the intermediate rail such that the intermediate rail underlaps or overlaps the head shelf after the frame of the bed is flipped by the end user to be upright for the corner leg to support the corner of the frame of the bed and the intermediate leg to support the intermediate rail as the intermediate rail extends along the side rail.

6. The kit of claim 5, wherein the set of slats is restable over the side shelf and the intermediate rail by the end user without usage of any hand tools such that a mattress can be deposited onto the set of slats supported by the side shelf and the intermediate rail.

7. The kit of claim 1, further comprising:

a headboard; and a fastener, wherein the fastener can fasten the headboard to the head platform above the head shelf after the frame of the bed is flipped by the end user to be upright for the corner leg to support the corner of the frame of the bed.

8. The kit of claim 1, further comprising:

a first package containing the head rail and the side rail; and a second package containing a headboard fastenable to the head platform above the head shelf after the frame of the bed is flipped by the end user to be upright for the corner leg to support the corner of the frame of the bed.

9. The kit of claim 1, wherein the corner leg is a first corner leg, wherein the post is a first post, wherein the side bore is a first side bore, wherein the side shelf includes a second side bore, wherein the corner is a first corner, and further comprising:

a second corner leg including a second post; and a foot rail including a foot platform and a foot shelf, wherein the foot shelf extends from the foot platform, wherein the foot shelf includes a foot bore, wherein the foot rail and the side rail can be assembled to form a second corner of the frame of the bed by the end user without usage of any hand tools when (a) the foot platform contacts the side platform such that the head platform opposes the foot platform, (b) the foot shelf underlaps or overlaps the side shelf, and (c) the second post extends into the foot bore and the second side bore.

10. The kit of claim 9, wherein the foot shelf underlaps the side shelf.

11. The kit of claim 9, wherein the foot shelf overlaps the side shelf.

12. A method, comprising:

sending a corner leg, a head rail, a set of slats, and a side rail to an end user, wherein the corner leg includes a post, wherein the head rail includes a head platform and a head shelf, wherein the head shelf extends from the head platform, wherein the head shelf includes a head bore, wherein the side rail includes a side platform and a side shelf, wherein the side shelf extends from the side platform, wherein the side shelf includes a side bore; and instructing the end user to assemble the head rail and the side rail to form a corner of a frame of a bed by an end user without usage of any hand tools by (a) having the head platform contact the side platform, (b) the head shelf underlap or overlap the side shelf, and (c) the post extend into the head bore and the side bore such that the set of slats rests on the side shelf and the side platform limits the set of slats in lateral movement when the bed is upright, wherein the head rail and the side rail are assembled to form the corner of the frame of the bed by the end user without usage of any hand tools before the frame of the bed is flipped by the end user to be upright for the corner leg to support the corner of the frame of the bed.

13. The method of claim 12, wherein the head shelf underlaps the side shelf.

14. The method of claim 12, wherein the head shelf overlaps the side shelf.

15. The method of claim 12, further comprising:

sending an intermediate rail and an intermediate leg to the end user, wherein the intermediate leg can be secured to the intermediate rail such that the intermediate rail underlaps or overlaps the head shelf after the frame of the bed is flipped by the end user to be upright for the corner leg to support the corner of the frame of the bed and the intermediate leg to support the intermediate rail as the intermediate rail extends along the side rail.

16. The method of claim 15, wherein the set of slats is restable over the side shelf and the intermediate rail by the end user without usage of any hand tools such that a mattress can be deposited onto the set of slats supported by the side shelf and the intermediate rail.

17. The method of claim 12, further comprising:

sending a headboard and a fastener to the end user, wherein the fastener can fasten the headboard to the head platform above the head shelf after the frame of the bed is flipped by the end user to be upright for the corner leg to support the corner of the frame of the bed.

18. The method of claim 12, further comprising:

sending a first package and a second package to the end user, wherein the first package contains the head rail and the side rail, wherein the second package contains a headboard fastenable to the head platform above the head shelf after the frame of the bed is flipped by the end user to be upright for the corner leg to support the corner of the frame of the bed.

19. The method of claim 12, wherein the corner leg is a first corner leg, wherein the post is a first post, wherein the side bore is a first side bore, wherein the side shelf includes a second side bore, wherein the corner is a first corner, and further comprising:

sending a second corner leg and a foot rail to the end user, wherein the second corner leg includes a second post, wherein the foot rail includes a foot platform and a foot shelf, wherein the foot shelf extends from the foot platform, wherein the foot shelf includes a foot bore, wherein the foot rail and the side rail can be assembled to form a second corner of the frame of the bed by the end user without usage of any hand tools when (a) the foot platform contacts the side platform such that the head platform opposes the foot platform, (b) the foot shelf underlaps or overlaps the side shelf, and (c) the second post extends into the foot bore and the second side bore.

20. The method of claim 19, wherein the foot shelf underlaps the side shelf.

21. The method of claim 19, wherein the foot shelf overlaps the side shelf.

22. The method of claim 12, wherein the head rail is T-shaped end-to-end, wherein the side rail is T-shaped end-to-end.

23. A device, comprising:

a bed frame including a head rail, a foot rail, a first side rail, a second side rail, a set of slats, a first corner leg, a second corner leg, a third corner leg, and a fourth corner leg, wherein the head rail includes a head platform and a head shelf, wherein the head shelf extends from the head platform, wherein the head shelf includes a first head bore and a second head bore, wherein the foot rail includes a foot platform and a foot shelf, wherein the foot shelf extends from the foot platform, wherein the foot shelf includes a first foot bore and a second foot bore, wherein the first side rail includes a first side platform and a first side shelf, wherein the first side shelf extends from the first side platform, wherein the first side shelf includes a first side bore and a second side bore, wherein the second side rail includes a second side platform and a second side shelf, wherein the second side shelf extends from the second side platform, wherein the second side shelf includes a third side bore and a fourth side bore, wherein the first corner leg includes a first post, wherein the second corner leg includes a second post, wherein the third corner leg includes a third post, wherein the fourth corner leg includes a fourth post, wherein the head rail and the first side rail form a first corner of the bed frame by (a) the head platform contacting the first side platform, (b) the head shelf underlapping or overlapping the first side shelf, and (c) the first post extending into the first head bore and the first side bore, wherein the head rail and the second side rail form a second corner of the bed frame by (a) the head platform contacting the second side platform, (b) the head shelf underlapping or overlapping the second side shelf, and (c) the second post extending into the second head bore and the third side bore, wherein the foot rail and the first side rail form a third corner of the bed frame by (a) the foot platform contacting the first side platform, (b) the foot shelf underlapping or overlapping the first side shelf, and (c) the third post extending into the first foot bore and the second side bore, wherein the foot rail and the second side rail form a fourth corner of the bed frame by (a) the foot platform contacting the second side platform, (b) the foot shelf underlapping or overlapping the second side shelf, and (c) the fourth post extending into the second foot bore and the fourth side bore, wherein the set of slats respectfully rests on the first side shelf or the second side shelf such that the first side platform or the second side platform respectfully limits the set of slats in respective lateral movement when the bed frame is upright, wherein the head rail is T-shaped end-to-end, wherein the foot rail is T-shaped end-to-end, wherein the first side rail is T-shaped end-to-end, wherein the second side rail is T-shaped end-to-end.

24. The device of claim 23, wherein the head shelf underlaps the first side shelf or the second side shelf.

25. The device of claim 23, wherein the head shelf overlaps the first side shelf or the second side shelf.

26. The device of claim 23, wherein the foot shelf underlaps the first side shelf or the second side shelf.

27. The device of claim 23, wherein the foot shelf overlaps the first side shelf or the second side shelf.

28. The device of claim 23, wherein the bed frame includes an intermediate rail and an intermediate leg, wherein the intermediate leg is secured to the intermediate rail such that the intermediate rail underlaps or overlaps the head shelf and the foot shelf between the first side rail and the second side rail.

29. The device of claim 28, wherein the set of slats rests on the intermediate rail and the first side shelf or the second side shelf between the head rail and the foot rail.

30. The device of claim 23, wherein at least one of:

(a) each of the head rail, the foot rail, the first side rail, and the second side rail is T-shaped;

(b) at least two of the head rail, the foot rail, the first side rail, and the second side rail has a rod extending underneath a respective shelf;

(c) the head rail or the foot rail mates with the first side rail or the second side rail to form a respective corner; or (d) further comprising: a headboard and a set of fasteners, wherein the set of fasteners can fasten the headboard to the head platform above the head shelf.

* * * * *